US006899845B2

(12) United States Patent
Kaieda

(10) Patent No.: US 6,899,845 B2
(45) **Date of Patent: *May 31, 2005**

(54) METHOD FOR SINTERING TUNGSTEN POWDER

(75) Inventor: Yoshinari Kaieda, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/385,706

(22) Filed: Mar. 12, 2003

(65) Prior Publication Data

US 2004/0001772 A1 Jan. 1, 2004

(30) Foreign Application Priority Data

Mar. 13, 2002 (JP) ..... 2002-069239

(51) Int. Cl.[7] ..... B22F 3/00
(52) U.S. Cl. ..... 419/18; 419/45
(58) Field of Search ..... 419/18, 45, 38

(56) References Cited

U.S. PATENT DOCUMENTS 5,188,678 A * 2/1993 Sekhar et al. ..... 148/514
5,380,409 A * 1/1995 Munir et al. ..... 205/340
5,996,385 A * 12/1999 Kecskes ..... 72/56

FOREIGN PATENT DOCUMENTS

JP 1344592 A2 * 9/2003 ..... B22F/3/10
JP 1344759 A2 * 9/2003 ..... C04B/35/56

OTHER PUBLICATIONS

Derwent 2000–298826, "Combustion synthesis process for manufacutring cemented carbide involves molding of reacitve owder mixture, heating by applying pressure, sintering and recovering", 2 pages, Apr. 28, 2000.*

* cited by examiner

*Primary Examiner*—Daniel J. Jenkins
(74) *Attorney, Agent, or Firm*—Wenderoth, Lind & Ponack, L.L.P.

(57) ABSTRACT

A formed body prepared by compacting tungsten powders is embedded in a powder mixture capable of performing combustion synthesis, a part of the powder mixture is powerfully heated to ignite the part and perform combustion synthesis, by the heat of formation released, a temperature of a formed body is instantaneously elevated to induce a sintering reaction, and a high temperature state is retained to convert a whole of the formed body into sintered tungsten.

12 Claims, 1 Drawing Sheet

METHOD FOR SINTERING TUNGSTEN POWDER

FIELD OF THE INVENTION

The present invention relates to a method for sintering tungsten powders. More particularly, the present invention relates to a method for sintering tungsten powders, which can prepare sintered tungsten having a high melting point with a better quality and at a low cost.

DESCRIPTION OF THE PRIOR ART

According to the powder metallurgy technique, sintered tungsten having a high melting point has been previously prepared as follows:

That is, tungsten powders are sintered by compacting the powders by mechanical pressing or cold isostatic pressing (CIP) to prepare a formed body having a bar-shape, attaching an electrode to the formed body, into which is electric current is directly passed in a flow of a hydrogen gas or an inert gas, and retaining the state for a long time. Such a process is adopted because tungsten is a metal having a very high melting point of about 3400° C. and a normal furnace cannot be used.

As apparent from the foregoing, the previous method for sintering tungsten powders according to the powder metallurgy technique inevitably needs use of electricity and a highly expensive gas such as a hydrogen gas, being relatively high cost. In addition, a temperature of a part of the formed body, to which an electrode is attached, is not elevated and therefore, sintering cannot be sufficient. Further, a manufacturing time is long, reflecting on a manufacturing cost.

The present invention has an object to provide a method for sintering tungsten powders, which can prepare sintered tungsten having a high melting point with a better quality and a low cost.

This and other objects, features, advantages of the invention will become more apparent upon reading of the following detailed specification and drawings, in which:

DETAILED DESCRIPTION OF THE INVENTION

Figure 1:
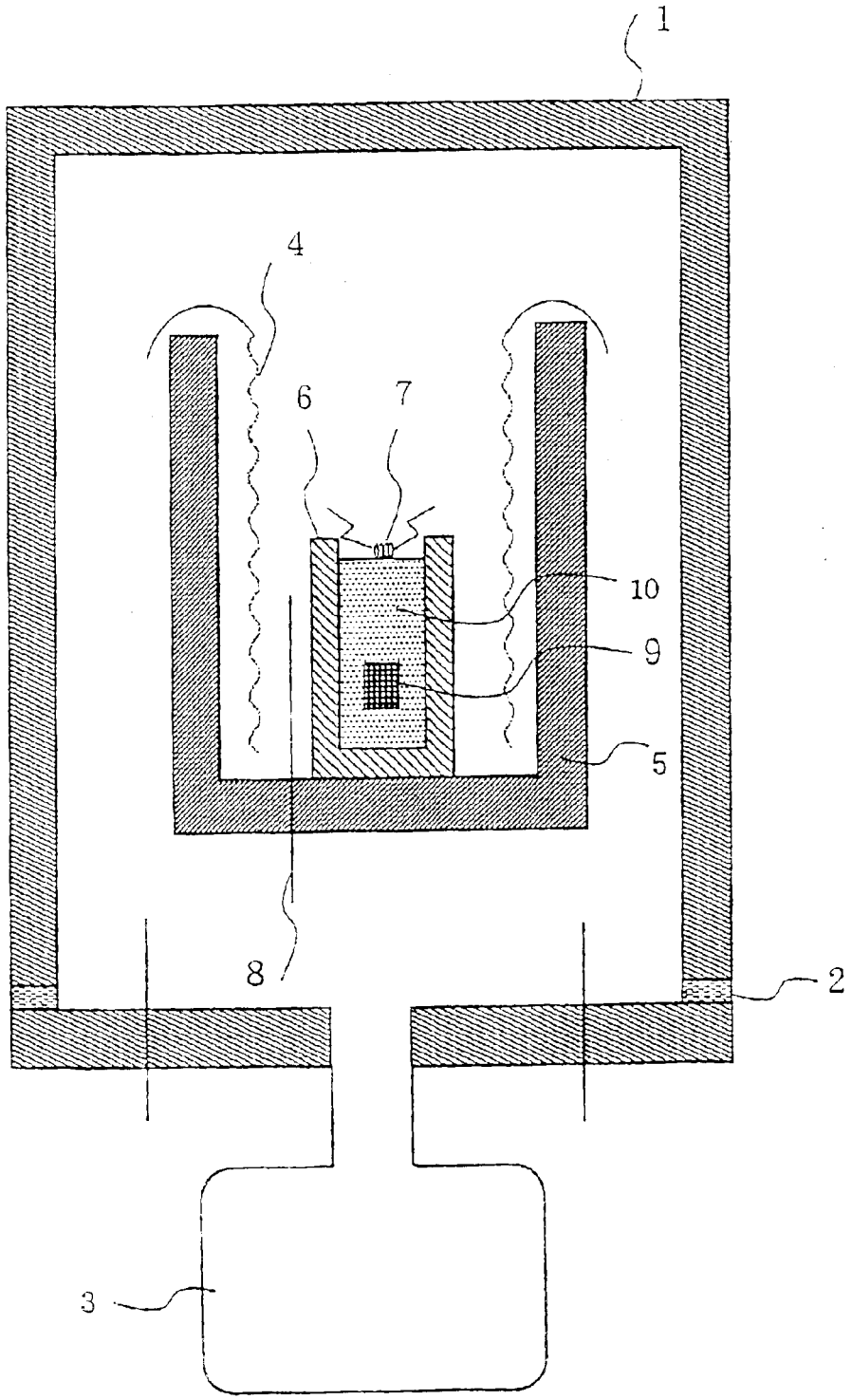
FIG. 1 is a cross-sectional view showing outline of an apparatus for combustion synthesis, which can be applied to a method for sintering tungsten powders of the present invention.

In order to attain the above object, that is, in order to obtain sintered tungsten in an as short time as possible by generating a high temperature without using electricity and an expensive gas such as a hydrogen gas, the present inventor studied intensively.

The present inventor has succeeded in combustion synthesis of a carbide and a boride. Combustion synthesis refers to synthesis in which a part of a powder mixture is powerfully heated to ignite the part and cause an initial reaction, heat of formation produced is successively propagated to cause a chain reaction, and a whole the powder mixture is synthesized into a compound such as a carbide and a boride.

Then, the present inventor obtained the technical findings that, by utilizing such combustion synthesis in sintering of tungsten powders, a high temperature can be generated without using electricity and an expensive gas such as a hydrogen gas and tungsten powders can be sintered in a short time. According to technical findings, the present invention was made.

For example, heat of formation of TiC is −184 kJ/mol and combustion synthesis of TiC is easily caused. An adiabatic temperature of TiC is 2937° C. and therefore, a temperature of tungsten is instantaneously elevated to a high temperature based on combustion synthesis of TiC and tungsten is sintered. That is, the necessary heat for sintering tungsten is complemented by heat of formation of a compound such as TiC, which is synthesized by combustion synthesis.

The present invention provides a method for sintering tungsten powders, which comprises the steps of embedding a formed body prepared by compacting a tungsten powder into a powder mixture capable of performing combustion synthesis, powerfully heating the powder mixture at a part to ignite the part and perform combustion synthesis, raising a temperature of the formed body instantaneously by heat of formation released and inducing a sintering reaction, and converting into sintered tungsten.

In addition, the present invention provides several aspects, one of the aspect in which the powder mixture capable of performing combustion synthesis is any one of powder mixtures selected from the group consisting of Ti and C, Zr and C, Nb and C, Ta and C, Hf and C, Ti and B, Zr, and B and Hf and B, one of the aspect in which combustion synthesis of the powder mixture and a reaction for sintering tungsten are performed under the conditions of room temperature or higher and 500° C. or lower in vacuum, one of the aspect in which a vacuum degree is set at $5\times10^{-1}$ Torr or lower and one of the aspect in which the powder mixture capable of performing combustion synthesis is pre-heated in vacuum to remove a moisture and volatile impurities contained in the powder mixture.

The method for sintering tungsten powders of the present invention will be explained in more detail by referring to Example.

EMBODIMENTS

In the method for sintering tungsten powders of the present invention, a formed body prepared by compacting tungsten powders is embedded into a powder mixture capable of performing combustion synthesis. The powder mixture capable of performing combustion synthesis refers to a powder mixture, which performs combustion synthesis, of which an adiabatic temperature thereupon is sufficiently high, and which releases heat of formation allowing tungsten powders to be sintered. The powder mixture includes the aforementioned powder mixture of Ti and C and any one of the powder mixtures of Zr and C, Nb and C, Ta and C, Hf and C, Ti and B, Zr and B, and Hf and B. Heat of formation for each powder mixture is, for example, −184 kJ/mol in the case of TiC, −140.6 kJ/mol in the case of NbC, −148.5 kJ/mol in the case of TaC, −218.8 kJ/mol in the case of HfC, −279.9 kJ/mol in the case of $TiB_2$, −326.6 kJ/mol in the case of $ZrB_2$, and −328.9 kJ/mol in the case of $HfB_2$. Each of the powder mixtures may have fundamentally a stoichiometric composition. For example, in the case of a powder mixture of Ti and C, an atomic ratio can be set at 1:1. But, and a few % of a powder of a material which does not relate to a combustion synthesis reaction, that is, which is not reactive, can added to the powder mixture in order to adjust an amount of produced heat.

In the method for sintering tungsten powders of the present invention, such a powder mixture is powerfully heated at a part to ignite the part and perform combustion synthesis. By heat of formation released, a temperature of a formed body of tungsten powders is instantaneously elevated to a high temperature to induce a sintering reaction and a high temperature state is retained to a certain extent after combustion synthesis of the powder mixture. For example, in the case of a powder mixture of Ti and C, a time necessary for combustion synthesis is an extremely short time by a few seconds or shorter when an amount of a powder mixture of Ti and C is from a few gram to a few tens gram. However, synthesized TiC by combustion synthesis retains a high temperature state for a while thereafter. As a result, a whole of the formed body is converted into sintered tungsten. When the formed body is removed together with synthesized compound such as TiC, a whole of the formed body is converted into sintered tungsten. Time necessary for producing sintered tungsten is a much shorter as compared with the previous long time retaining with directly passing electric current. In addition, since an electrode is not attached, sintering is performed throughout a formed body and a better quality of sintered tungsten is obtained.

More specifically, when a method for sintering tungsten powders of the present invention is conducted, an apparatus for combustion synthesis, outline of which is shown in FIG. 1, can be employed.

As show in FIG. 1, an apparatus for combustion synthesis is provided with a vacuum container (1). The vacuum container (1) is sealed with a sealing mechanism (2) and is connected to a gas supplying and discharging system (3), allowing gas in the interior to be supplied and discharged. In the interior of the vacuum container (1), an electric furnace (5) provided with a heater (4) and a thermocouple (8) is arranged. In the interior of the electric furnace (5), a refractory crucible (6) is disposed. A powder mixture (10) capable of performing combustion synthesis such as Ti and C is filled in the refractory crucible (6).

In addition, in the apparatus for combustion synthesis, an electrically heating coil (7), which can be formed of a tungsten wire or a nichrome wire, for powerfully heating a part of the powder mixture (10) to ignite the part is arranged and, usually, the electrically heating coil (7) is arranged so as to contact with an upper end of the powder mixture (10) filled in the refractory crucible (6).

The aforementioned heater (4), electrically heating coil (7) and thermocouple (8) are all drawn to an outside from the vacuum container (1) so that the airtight state is retained, and are electrically connected to a power supply and a controller to be operated from the outside.

When sintering of tungsten powders, a formed body (9) prepared by compacting tungsten powders is embedded into the powder mixture (10) filled in the refractory crucible (6). Prior to embedding the formed body (9), the powder mixture (10) can be pre-heated in vacuum to remove a moisture and volatile impurities contained in the powder mixture (10). In the case of this sintered tungsten having a better quality is obtained.

Thereafter, the refractory crucible (6) is placed into the electric furnace (5) and the vacuum container (1) is sealed with a sealing mechanism (2). Then, the interior of the vacuum container (1) is evacuated to vacuum by actuation of the gas supplying and discharging system (3). It is preferable that a vacuum degree at that time is set to be suitable for causing combustion synthesis of the powder mixture (10), for example, a vacuum degree being $5\times10^{-1}$ Torr or lower. In addition, as a vacuum degree is heightened, it is effective to suppress production of an oxide in sintered tungsten.

Then, an electrically heating coil (7) is arranged contacting with a part of a the powder mixture (10), more particularly, an upper end as shown in FIG. 1 and electrical current is passed through the heating coil (7) to powerfully heat to ignite an upper end, that is, a part of the powder mixture (10). After ignition, in the powder mixture (10), an initial reaction, for example in the case of a powder mixture of Ti and C, a reaction represented by Ti+C→TiC occurs, heat of formation produced is successively propagated to cause a chain reaction. As a result, combustion synthesis occurs. Finally, a whole of the powder mixture (10) is converted into a compound such as a carbide, for example, TiC, and a boride. In addition, by heat of formation released during combustion synthesis of the powder mixture (10), a temperature of the formed body (9) is instantaneously elevated to a high temperature, a sintering reaction is induced and a high temperature state is retained. A whole of the formed body (9) is converted into sintered tungsten.

As described above, it is preferable that combustion synthesis of the powder mixture (10) and a sintering reaction of tungsten are performed in vacuum. Besides, when a temperature in the electric furnace (5) is retained at a room temperature or higher and 500° C. or lower by the heater (4), a relative density of sintered tungsten becomes almost 90%.

Sintering of tungsten powders, which previously required direct electric current and long time retaining, can be performed without using electricity and a hydrogen gas and in a short time. Sintered tungsten has a better quality and can be produced at a low cost.

EXAMPLES

Using W powders having an average particle diameter of about 20 μm, C powders having an average particle diameter of about 15 μm and Ti powders having an average particle diameter of 30 μm, the W powders were prepared into a cylindrical formed body having a thickness of around 10 mm with a circular mold having a diameter of 11.28 mm at a forming pressure of 150 MPa. Then, the resulting formed body was packed into a polyurethane rubber mold, a forming pressure of 400 MPa was applied isostatically by cold isostatic pressing (CIP), and the pressure was retained for 1 minute to reform.

On the other hand, as a powder mixture capable of performing combustion synthesis, a powder mixture of Ti and C was prepared at an atomic ratio of 1:1, which was retained at 200° C. for 12 hours to dry.

The powder mixture of Ti and C as a powder mixture (10) capable of performing combustion synthesis was placed into a refractory crucible (6) in an apparatus for combustion synthesis as shown in FIG. 1 and a formed body (9) of tungsten was embedded the powder mixture of Ti and C. Thereafter, the refractory crucible (6) was arranged in the electric furnace (5) and an electrically heating coil (7) formed of a tungsten wire having a wire diameter of 0.6 mm was arranged contacting with an upper end of a powder mixture of Ti and C. In this state, a vacuum container (1) was sealed with a sealing mechanism (2), the interior of the vacuum container (1) was evacuated to vacuum with a gas supplying and discharging system (3), and a vacuum degree was always retained at $1\times10^{-3}$ Pa or lower. An electric current of around 20 A was passed through the electrically heating coil (7) to powerfully heat an upper end of the powder mixture of Ti and C to ignite the part.

After ignition, a reaction represented by Ti+C→TiC was caused, heat of formation produced was successively propagated, a chain reaction was passed, and a whole of the powder mixture (10) was synthesized into TiC in a short time by combustion synthesis. Further, by heat of formation released, a sintering reaction was induced in the formed body (9) and a whole of the formed body (9) was converted into sintered tungsten. An experiment was performed repeatedly and a relative density of the resulting sintered tungsten was 90% or larger.

Of course, the present invention is not limited by the above embodiments and Example. Regarding details such as conditions at combustion synthesis, a particle diameter of powders used, and a kind of powder mixtures capable of performing combustion synthesis, various modification is possible certainly.

What is claimed is:

1. A method for sintering tungsten powders, which comprises the steps of embedding a formed body prepared by compacting a tungsten powder into a powder mixture capable of performing combustion synthesis, powerfully heating the powder mixture at a part to ignite the part and perform combustion synthesis, raising a temperature of the formed body instantaneously by heat of formation released and inducing e a sintering reaction, and converting into sintered tungsten.

2. The method for sintering tungsten powders according to claim 1, wherein the powder mixture capable of performing combustion synthesis is any one of powder mixtures selected from the group consisting of Ti and C, Zr and C, Nb and C, Ta and C, Hf and C, Ti and B, Zr, and B and Hf and B.

3. The method for sintering a tungsten powder according to claim 1, wherein combustion synthesis of the powder mixture and a reaction for sintering tungsten are performed under the conditions of room temperature or higher and 500° C. or lower in vacuum.

4. The method for sintering a tungsten powder according to claim 2, wherein combustion synthesis of the powder mixture and a reaction for sintering tungsten are performed under the conditions of room temperature or higher and 500° C. or lower in vacuum.

5. The method for sintering tungsten powders according to claim 3, wherein a vacuum degree is set at $5\times10^{-1}$ Torr or lower.

6. The method for sintering tungsten powders according to claim 4, wherein a vacuum degree is set at $5\times10^{-1}$ Torr or lower.

7. The method for sintering tungsten powders according to claim 1, wherein the powder mixture capable of performing combustion synthesis is pre-heated in vacuum to remove a moisture and volatile impurities contained in the powder mixture.

8. The method for sintering tungsten powders according to claim 2, wherein the powder mixture capable of performing combustion synthesis is pre-heated in vacuum to remove a moisture and volatile impurities contained in the powder mixture.

9. The method for sintering tungsten powders according to claim 3, wherein the powder mixture capable of performing combustion synthesis is pre-heated in vacuum to remove a moisture and volatile impurities contained in the powder mixture.

10. The method for sintering tungsten powders according to claim 4, wherein the powder mixture capable of performing combustion synthesis is pre-heated in vacuum to remove a moisture and volatile impurities contained in the powder mixture.

11. The method for sintering tungsten powders according to claim 5, wherein the powder mixture capable of performing combustion synthesis is pre-heated in vacuum to remove a moisture and volatile impurities contained in the powder mixture.

12. The method for sintering tungsten powders according to claim 6, wherein the powder mixture capable of performing combustion synthesis is pre-heated in vacuum to remove a moisture and volatile impurities contained in the powder mixture.

* * * * *